US006102235A

United States Patent [19]

Stern et al.

[11] Patent Number: 6,102,235

[45] Date of Patent: Aug. 15, 2000

[54] LID WITH INTEGRAL PAINT ROLLER TRAY

[76] Inventors: Max M. Stern, 24284 Ontario La., Lake Forest, Calif. 92630; Elyon Krok, 53 Firwood, Irvine, Calif. 92604

[21] Appl. No.: 09/457,052

[22] Filed: Dec. 7, 1999

Related U.S. Application Data

[63] Continuation-in-part of application No. 09/215,365, Dec. 18, 1998, and a continuation-in-part of application No. 09/294,066, Apr. 19, 1999.

[51] Int. Cl.[7] ..... B44D 3/12

[52] U.S. Cl. ..... 220/212; 220/570; 220/254; 220/832; 220/835; 15/257.06

[58] Field of Search ..... 220/212, 212.5, 220/570, 571.1, 696, 699–701, 254, 256, 259, 831, 832, 833, 835, 845, 846; 206/508, 509, 511; 15/257.06, 257.05

[56] References Cited

U.S. PATENT DOCUMENTS

| | | | |
|---|---|---|---|
| 2,172,327 | 9/1939 | Baird | 220/831 |
| 2,777,142 | 1/1957 | Verde | 15/257.05 |
| 4,469,239 | 9/1984 | Gallery, IV et al. | 220/831 |
| 4,928,843 | 5/1990 | Gunderson | 15/257.06 |
| 5,085,317 | 2/1992 | Jensen et al. | 15/257.06 |
| 5,085,331 | 2/1992 | Groya et al. | 220/832 |
| 5,404,611 | 4/1995 | Raney | 15/257.06 |
| 5,472,111 | 12/1995 | Renfrew | 220/570 |
| 5,975,346 | 11/1999 | Imperato et al. | 220/831 |

FOREIGN PATENT DOCUMENTS

| | | | |
|---|---|---|---|
| 4123513 | 1/1993 | Germany . | |
| 89/07532 | 8/1989 | WIPO | 15/257.06 |

*Primary Examiner*—Stephen K. Cronin
*Assistant Examiner*—Nathan Newhouse
*Attorney, Agent, or Firm*—John J. Murphey

[57] ABSTRACT

A paint container lid with integral, self-supporting paint roller tray including a planar lid surface defined by a peripheral border and including means for attaching the border in a sealing relationship to the upper boundary of a paint container, a first opening formed in the lid surface defined by a peripheral edge, a cover for the first opening having a planar first surface and an opposite, textured second surface, the cover pivotally attached along a portion thereof to the lid, means to attach the cover to the lid, the cover capable of first and second configurations with the lid, in the first configuration, the planar first cover surface is arranged in co-planar relationship with the planar lid surface when the cover is placed flat over the opening with the planar first cover surface facing upward, in the second configuration, the textured, second cover surface is arranged facing upward at an acute angle with the lid, the cover slanting toward the first opening, to act as a paint roller tray, and a support integral with the lid surface moveable from a first storage position, substantially planar with the lid surface, to a second support position against the cover when the cover is in the second configuration.

30 Claims, 18 Drawing Sheets

LID WITH INTEGRAL PAINT ROLLER TRAY

RELATION TO OTHER PATENT APPLICATIONS

This is a continuation-in-part application of our previously filed U.S. patent applications (1) Drip Tray as Lid of Container, filed Dec. 18, 1998 and given Ser. No. 09/215,365, and (2) Container with Sloped Floor That Incorporates Ladder Attachment, filed Apr. 19, 1999 and given Ser. No. 09/294,066.

BACKGROUND OF THE INVENTION

1. Field of the Invention

This invention pertains to the field of containers for storing liquids such as paint. More particularly, the invention pertains to a novel top or lid for a paint container that may act as a paint-roller tray or drip tray for use in applying the paint to walls, etc. with a roller or paint brush.

2. Description of the Prior Art

For industrial, as well as home use, paint is traditionally hauled to the work site in 1, 2-½, and 5 gallon buckets, stirred in the bucket to homogenize the contents, add color if necessary, and then poured into one or more wide, shallow, paint-roller trays to be lifted and carefully placed on the rungs or on top of a step ladder for the painter's use in wetting the roller and applying the paint. As anyone knows who has undertaken this task, pouring paint from a large container into a shallow paint-roller tray is fraught with inconvenience and difficulty from small splashes from the paint tray to accidental spills from the paint bucket and tray, to sloshing paint out of the tray while re-wetting the paint roller. The shallow paint tray is especially cumbersome because the paint is heavy and subject to sloshing and if the tray is tilted, it causes one side or end of the tray to become heavier than the other, requiring upward force to be used to lift the heavy side of the tray which often results in over-compensation and spilling of paint from the opposite side of the tray.

Purchasing a paint-roller tray requires only a small outlay of money. However, at the end of the day, there is the messy job of cleaning it so that by next use of the tray, there is no dried paint on the tray to be rolled on the wall with a new batch of paint. Accordingly, using a paint-roller tray is messy, causes unwanted spills, and is labor-intensive to clean following use.

The prior art has tried to solve these problems by combining the paint tray with the paint lid. U.S. Pat. No. 3,828,389, discloses a rectangular paint container having a lid hinged along one side where the underside of the hinge has an upstanding rim molded about a plurality of ribs that serves, when the lid is completely opened and braced at the free end by the carrying handle, as a paint roller tray. While this combines the tray with the container, the tray is useful only in a rectangular configuration that must be constantly filled with paint from an external source. Further, the container cannot be used on a ladder or other narrow support surface because the handle must support the paint roller tray apart from the container.

U.S. Pat. No. 4,928,843 discloses an integral paint can and roller pan combination where a specially made elliptical paint can is topped with a lid having a textured underside. Exposed pivot housings and support arms are attached to the upper surface of the lid that can later be arranged to support the lid in upside down configuration to act as a paint tray.

While this is a novel approach to the problem, it requires a special and expensive type of paint can and, additionally, suffers from having exposed supports on top of the lid that can be bent, broken and otherwise damaged when similar cans full of paint are stacked on top of each other as is required in many stores and at construction sites.

U.S. Pat. No. 5,472,111 discloses a rectangular container having a lid whose upper surface is formed into a paint-roller tray, including an upstanding side rim and a textured surface, and having a pair of rigid flaps extending downward on opposite sides of the tray for assembly with projections molded on the outside of the bucket to support the paint roller tray on top of the bucket when the lid is loosened and slid partially toward one side of the container to provide access to the paint in the container. With the paint-roller tray exposed during periods of non-use, it is subject to be smeared with dirt, grease, tar, or other materials found about work sites. These materials would be difficult to clean from the ribs, slots, or other textures in the tray. In addition, the paint roller tray prevents stacking of like paint-filled containers without danger of damage to the rim and/or the textured surface. Further, the container must be made with special molded projections on the outside thereof which makes them more expensive and raises the price of the paint. Still further, the paint roller tray must be cleaned at the end of each use so that wet paint does not smear onto other objects placed near the lid.

U.S. Pat. No. 5,404,611 discloses a paint roller container and lid combination where the underside of the lid contains a textured surface and surrounding rim to serve as a paint roller tray. The combination is used by removing the lid from the rectangular container, turning the lid over and inserting the forward corners of the side edges into special receptacles mounted on the inside walls of the container. This special-configuration lid is only useful with the special-configuration container and is expensive to build with the interior receptacles. The lid must be cleaned after use, before replacing the lid, otherwise the paint container will be soiled.

Each of the above prior art patents requires support for the paint roller tray from the container itself. This requires the container to have some internal or external fitting provided and these fittings interfere with the stackable nature of the containers. Accordingly, it clearly appears there continues to be a need for a lid for use with ordinary paint containers, as well as special-configuration containers, that has a paint-roller tray integral therewith and supported solely by the lid and that does not otherwise possess the disadvantages of the prior art devices.

SUMMARY OF THE INVENTION

This invention is a novel lid for a paint container that has an integral, self-supporting paint-roller tray, i.e., it is a lid having an integral paint-roller tray that is solely supported by the lid and requires no protruding fittings on the container. It can be applied to a typical paint bucket. The lid may be combined with an existing paint container to produce the benefits hereinafter described. Further, it can be combined with a paint container that can be temporarily attached to a standard ladder or step ladder to bring even more benefits to the combination. It can be used as a paint roller tray on any kind of surface. It does not require special fittings on the container. The lid has a planar top surface allowing it to be stacked with other paint-filled containers without the possibility of damage to the lid. It has no exposed supports or other contrivances that would be damaged when stacked.

The textured surface used as the paint roller tray is not placed exterior the container until needed so that the tray surface is not exposed to dirt, grease, or other harmful materials.

The invention is a paint container lid with integral, self-supporting, paint roller tray comprising a planar lid surface defined by a peripheral border and including means for attaching the border in a sealing relationship about the upper boundary of a paint container, a first opening formed in the lid surface, a cover for the first opening having a planar first surface and an opposite, textured second surface, the cover pivotally attached along a portion thereof to the lid and solely supported by said lid and capable of first and second configurations with the lid, where, in the first configuration, the planar first cover surface is arranged in co-planar relationship with the lid surface when the cover is placed flat over the opening with the planar first cover surface facing upward and, in the second configuration, the textured, second cover surface is arranged facing upward at an angle with the cover, the surface slanting toward the first opening that now remains open, to act as a paint-roller tray, and a support integral with the lid and moveable from a first storage position to a second support position against the cover when the cover is in its second configuration. In addition, the novel lid of this invention can be used in combination with virtually any paint container. Further, it is combinable with a generally rectangular paint container having slanted side walls so that, when filled with paint, the container is stackable on top of other like containers and, when empty, is nestable, and the lids are stackable, because of their planar configuration. This invention may be used on different volume containers, using the same sized lid of this invention, where the containers vary only in depth and thus are stackable, i.e., a 2-½ gallon paint container. The lid of this invention is stackable by itself and the lid-container combination is stackable. One such lid-container combination is particularly useful where the container has a special design at the base thereof for attachment to the rung, step, or top of a ladder.

Accordingly, the main object of this invention is a paint container lid with an integral, self-supporting, paint-roller tray, solely supported by the lid, and having a planar top for easy and efficient stacking. Other objects of the invention include a paint container lid that can be used as a paint-roller tray on restricted surfaces such as a rung, step, or top of a ladder; a paint-container lid that is adaptable to automated machinery currently being used to automatically fill and seal a container with a lid thereon; a paint- container lid having a surface useful as a paint roller tray where all the supports of the tray are integral with the lid relieving the requirements to have special fittings, attachments, and support devices molded into or otherwise attached to the interior or exterior of the walls of the container; a paint container lid having support for the paint roller tray in planar configuration with the rest of the lid to eliminate the potential for physical damage to the tray support when the lid is stacked with other heavy containers or materials; a lid having a paint roller tray that remains out of exposure until needed thus eliminating the potential for damage to the tray from spilled liquids; a lid with integral paint roller tray that is foldable down in sealing relationship into the space above the bulk of the paint in the container so that the tray does not need to be cleaned following use because the seal between the container and the lid keeps air away from the paint that could cause skinning and drying of the paint left on the tray; and, a novel paint container with lid combination that is both stackable and nestable for more efficient storage.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE PREFERRED EMBODIMENT

Figure 1:
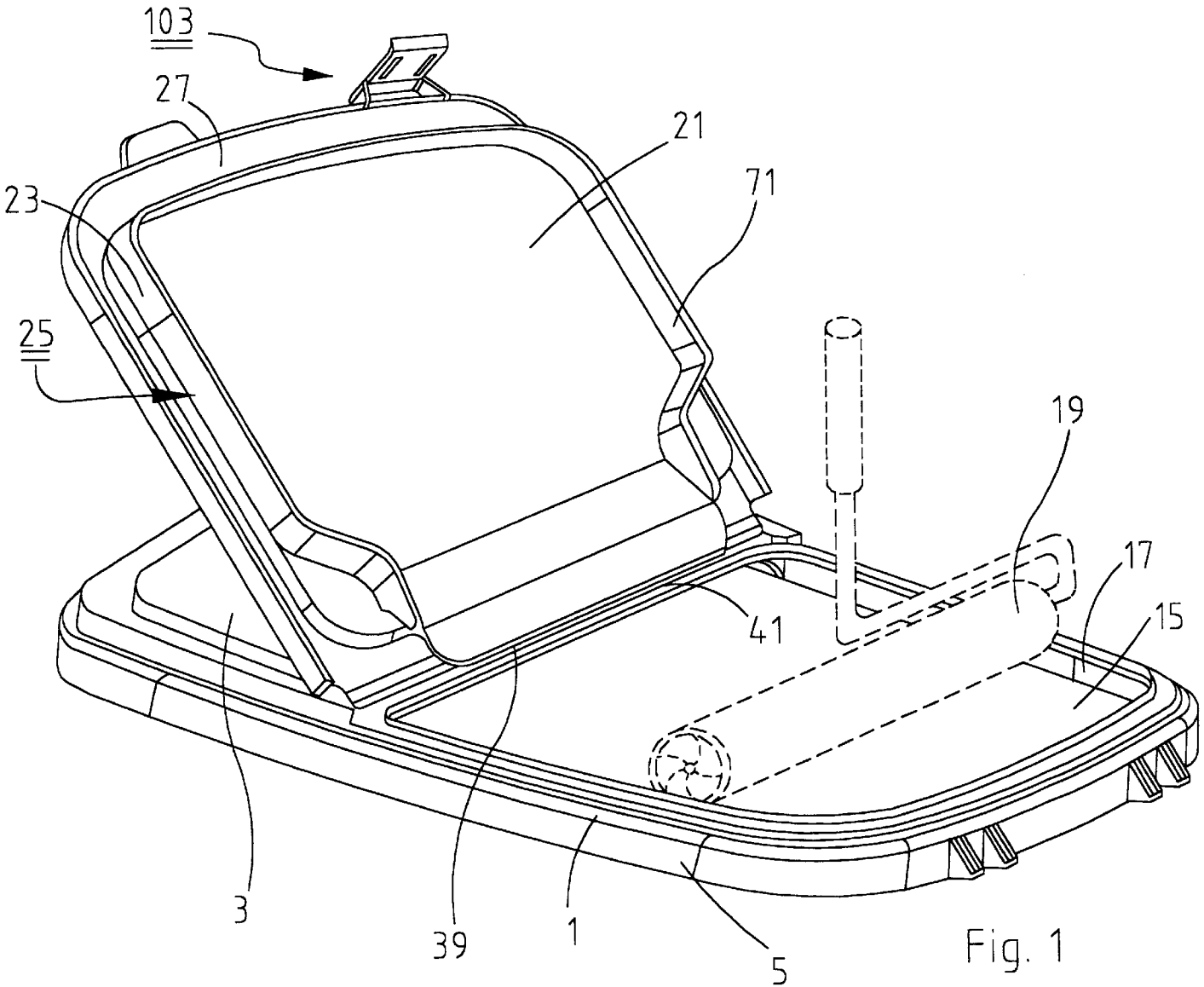
FIG. 1 is a front isometric view of the lid of this invention showing the cover in its second configuration.

Turning now to the drawings wherein elements are identified by numbers and like elements are identified by like numbers throughout the 20 drawings, the paint container lid 1 of this invention is depicted in FIGS. 1 through 5 as having a planar surface 3 defined by a peripheral border 5 and including first means 7 for attaching border 5 in a sealing relationship to the upper boundary 9 of a paint container 13. Border 5 is preferably made in a generally rectangular configuration, with rounded corners, and paint container 13 should have a similar rectangular shape and rounded corners so that the inter-attachment therebetween fully seals the paint in container 13. This is not to be taken as limiting the invention in any way. This novel lid is just as useful with a typical cylindrical 5-gallon paint bucket and other such known and unknown configured containers and their use in combination with this invention is fully contemplated herein. Whatever the configuration of the paint container, border 5 can be made to fit it so that the inventive lid can be placed in sealing relationship with virtually any container.

Figure 3:
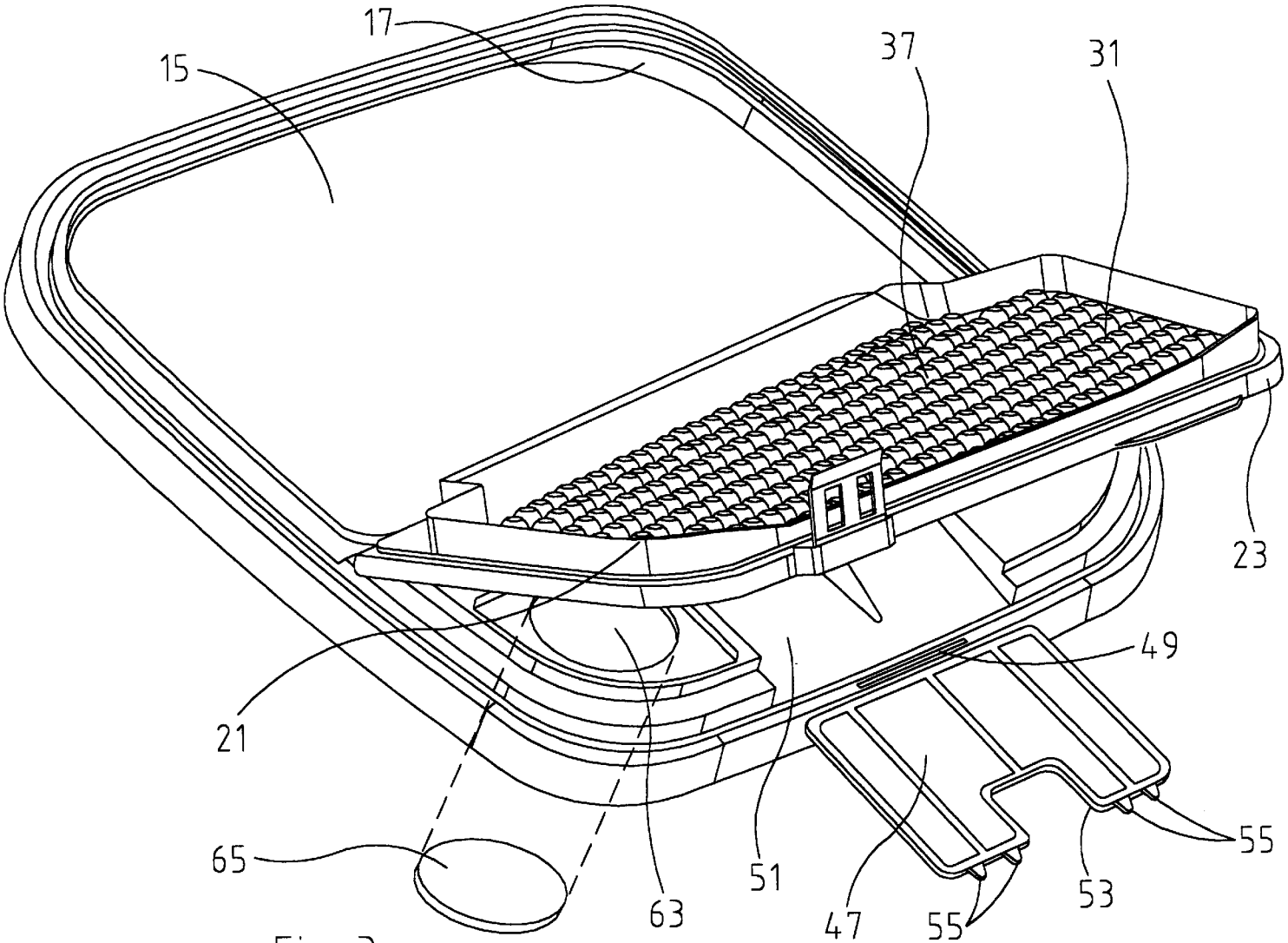
FIG. 3. is another isometric view of the lid of this invention, taken from another angle, showing the cover in its second configuration with its textured surface and shows the bifid strut planar with the lid before it is rotated into support position underneath the cover.

A first opening 15 is formed in lid surface 3, defined by a peripheral boundary 17, to provide access from outside to the paint inside container 13 when lid 1 is sealed over container boundary 9 and first opening 15 is allowed to remain open. The dimensions of opening 15 are preferred to be such as to allow passage of a typical paint roller 19 therethrough (shown in dotted outline in FIG. 1), when the roller portion thereof is held in level attitude with lid 1 and passed downward through first opening 15 and into contact with the surface of the paint remaining in container 13 (not shown). The front-to-rear dimensions of opening are preferred to be sufficiently wide as to allow roller 19 to be easily passed through opening 15 when roller 19 is touched onto the paint surface to fill or re-wet it. A rectangular first opening 15, as shown in FIG. 3, is preferred. First opening 15 can be larger than these preferred dimensions and these other dimensions are fully contemplated in this invention.

A cover 21 is provided for closing over first opening 15 in sealing relationship, said cover defined by a peripheral edge 23 including second means 25 for sealing against first opening peripheral boundary 17. Second means 25 may include a foam, plastic, or other flexible seal or gasket, attached about cover 21, and adapted to press against lid 1. Cover 21 has a planar first surface 29 (see FIG. 14) and an opposite, textured second surface 31 (see FIGS. 3 and 4). Second, textured, surface 31 lies underneath planar first surface 29 and said textured surface 31 is arranged to accommodate the surface of roller 19.

Figure 4:
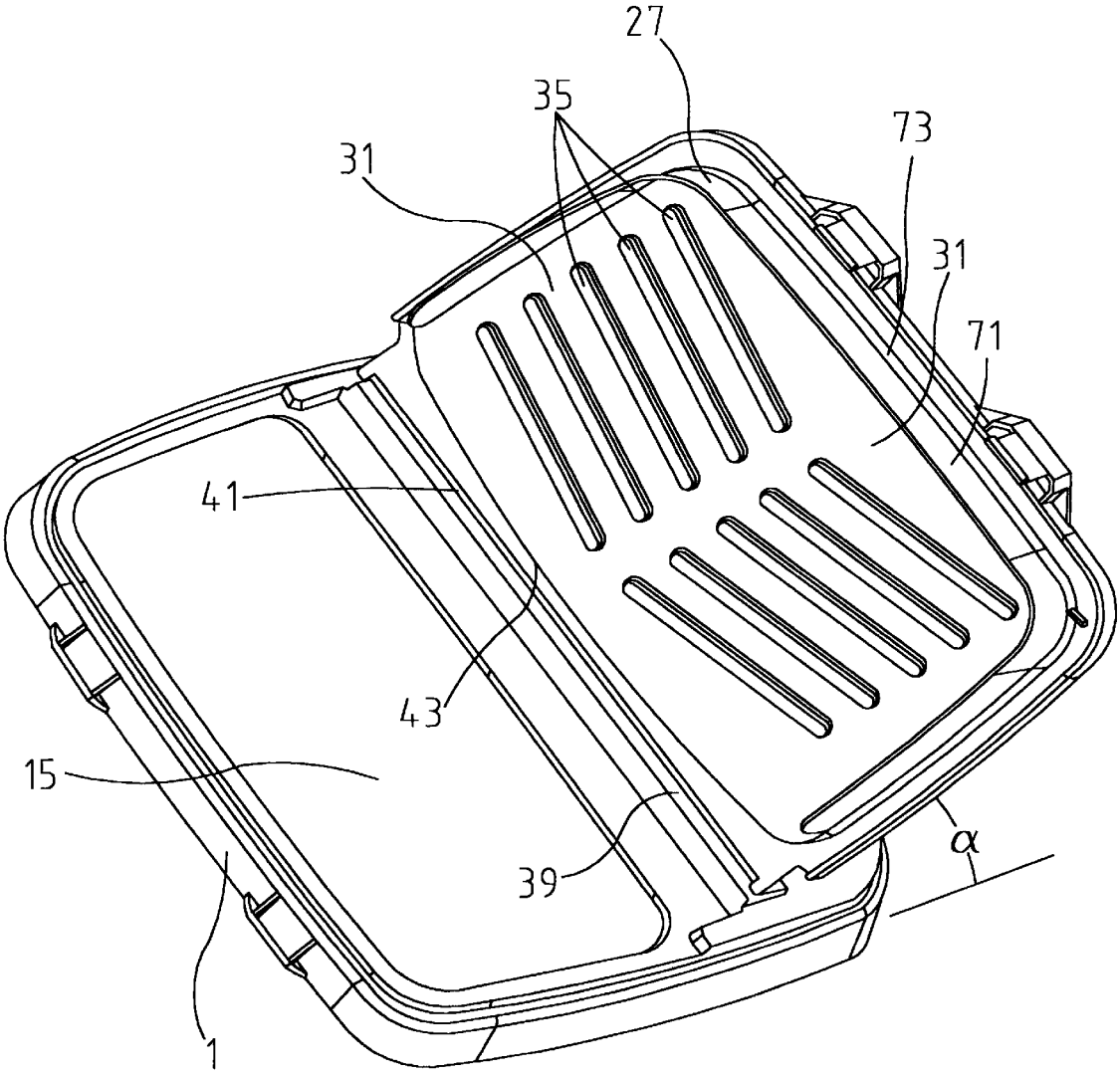
FIG. 4 is an isometric view of the cover in its second configuration with its rib textured surface and shows the latches used to hold the cover tightly over the first opening in the lid.

Textured surface 31 may take a variety of forms. Shown in FIG. 4 is a textured surface comprising a plurality of upstanding narrow ribs 35 that are slanted in a specific direction. Shown in FIG. 3 is a textured surface comprising a plurality of protrusions 37. Ribs 35 may be made in a wavy pattern or slanted one way or the other while protrusions 37 may be out-protrusions or in-protrusions of regular or irregular size. Cover 21 is attachable along one edge 39 to lid 1 along a pivotal connection 41 and cover 21 is capable of first and second configurations with respect to the rest of lid 1, each of which stems from cover 21 being solely supported on lid 1.

Figure 14:
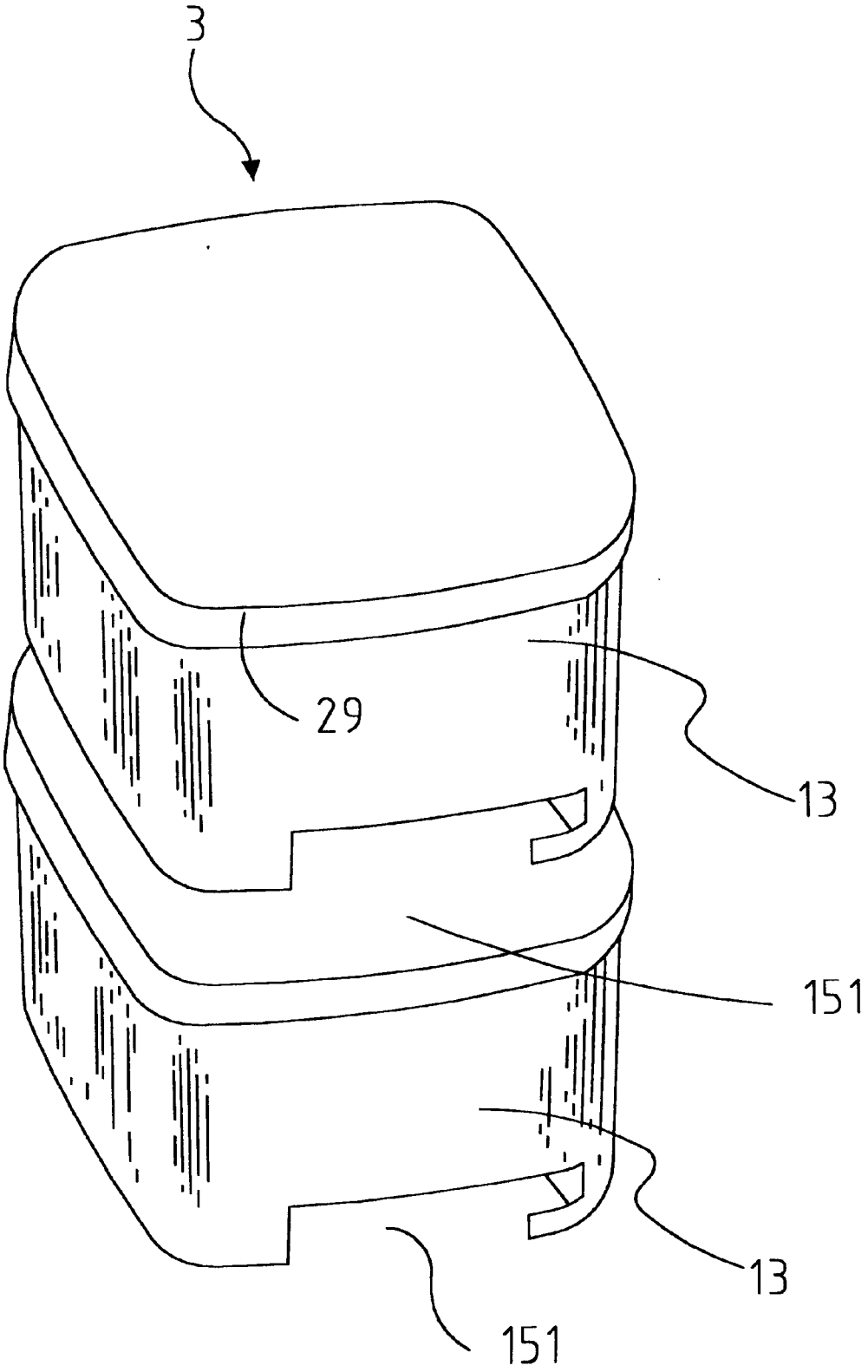
FIG. 14 is an illustrative view of two combination lid/container stacked one on top of each other and further showing the novel means for temporarily attaching the container to the step, rung, or top of a step ladder.

In its first configuration, as shown in FIG. 14, cover 21 is arranged flat against lid 1 and covers over first opening 15 to place planar first surface 29 in co-planar relationship with lid planar surface 3. In this configuration, planar first surface 29 faces upward so that the entire top surface of lid 1 is substantially planar. The word "substantially" is used because, in the preferred embodiment and as will be explained later, there is at least one other closeable opening and at least one slightly depressed area formed in lid planar surface 3 that interrupts the pure planar features of lid 1. However, for the most part, lid 1 is flat or planar on top. In this first configuration, cover 21 completely covers over first opening 15 and sealing means 25 extends about peripheral boundary 16 so that paint container 13 is entirely sealed about its upper boundary 9.

In its second configuration, alternatively shown in FIGS. 1 through 4, cover 21 is lifted from first opening 15, rotated about pivotal connection 41, and adjusted to establish cover 21 at an acute angle "$\alpha$", preferably about 30°, with lid 1 to expose textured second surface 31 and open first opening 15 to allow access to the paint in container 13. Textured second surface 31 faces upward from lid 1 even though at an acute angle as aforesaid. In this position, textured second surface 31 acts as a paint roller tray that is slanted downward toward first opening 15 with cover forward edge 43 at or near one side of first opening 15.

Figure 2:
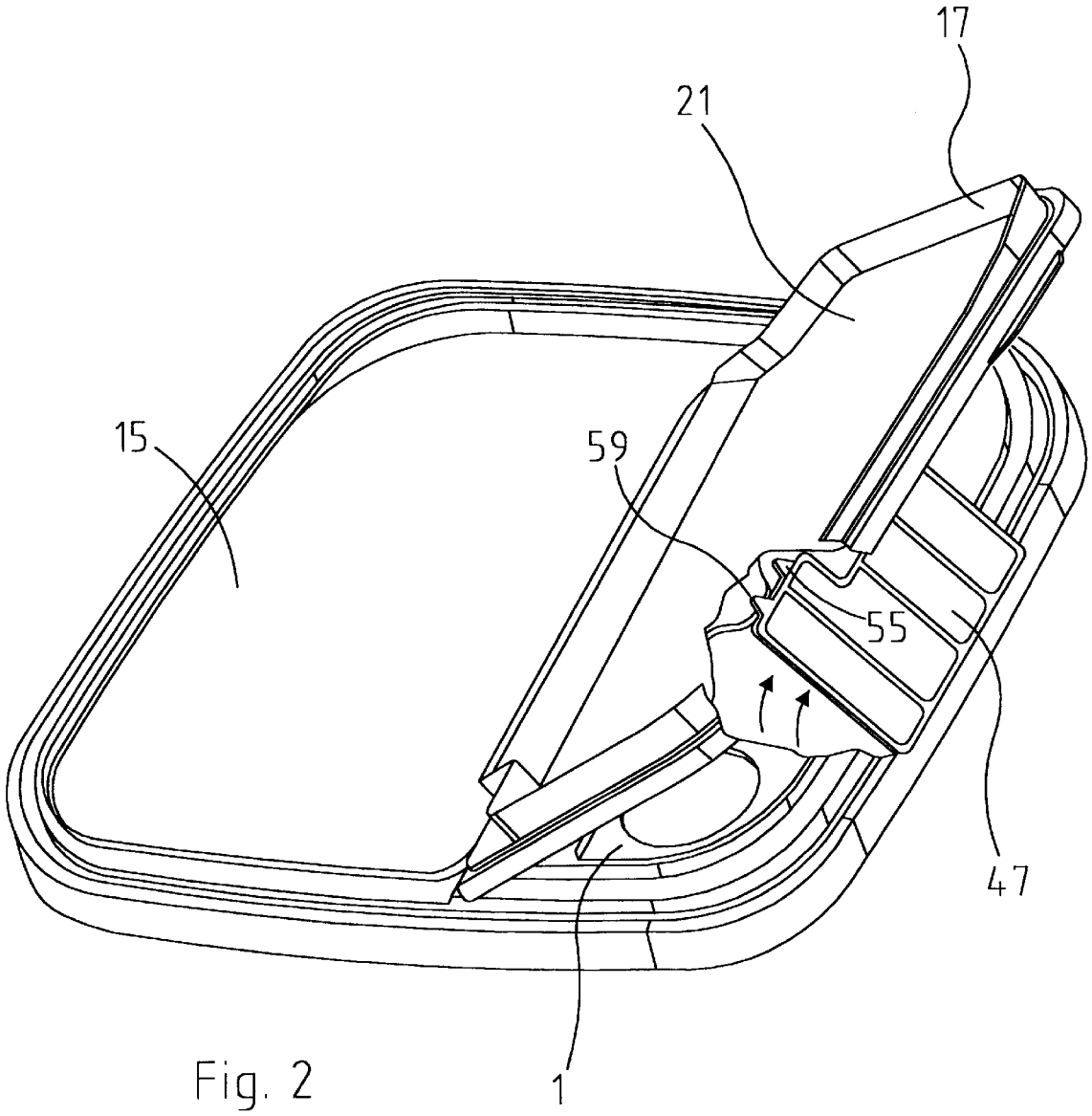
FIG. 2 is a rear isometric view of the lid shown in FIG. 1 showing, in partial cutaway form, the means of supporting the paint tray in its second configuration.
Figure 5:
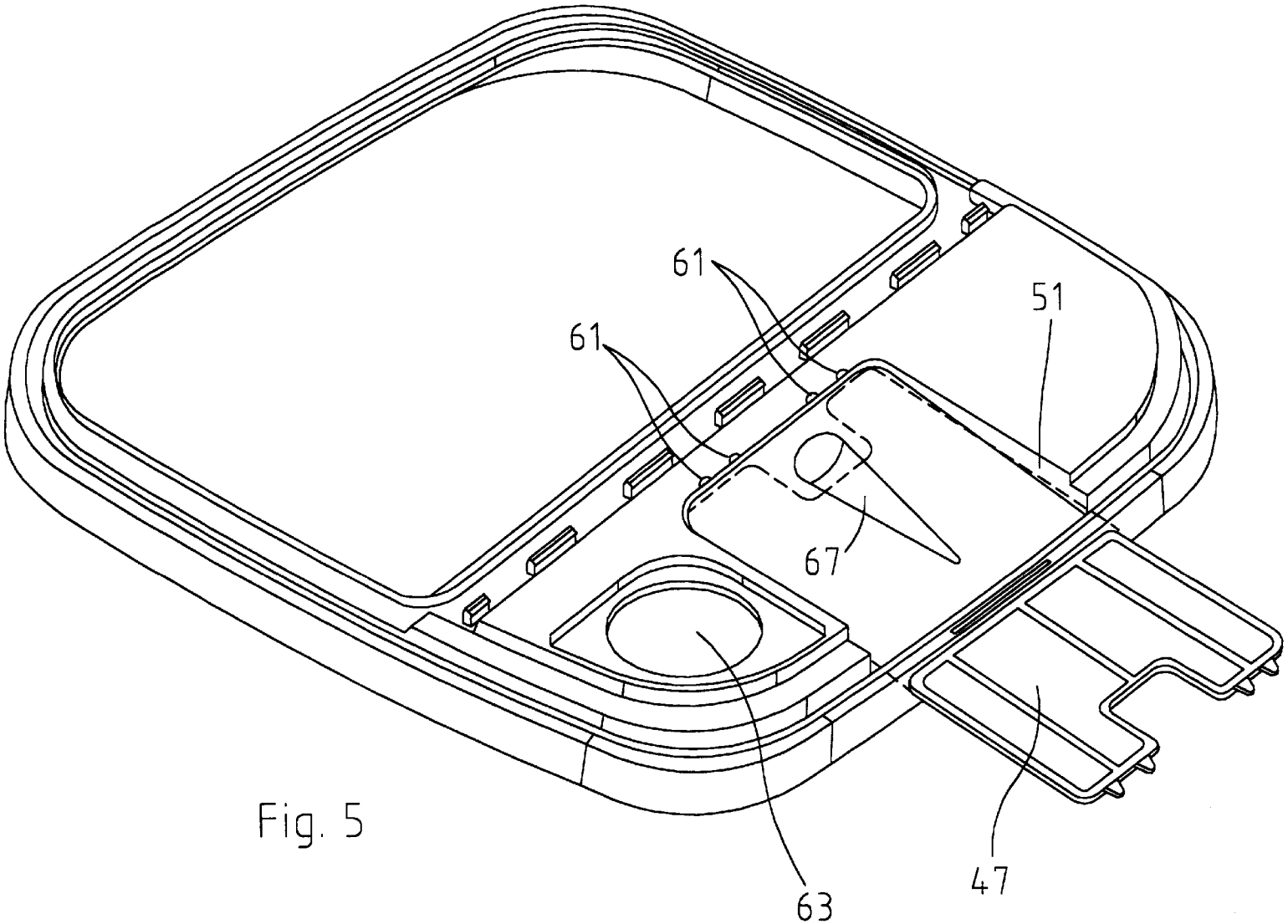
FIG. 5 is an isometric view of the cover in its first configuration and shows the bifid strut extending outward from its hinged attachment to the lid.
Figure 15:
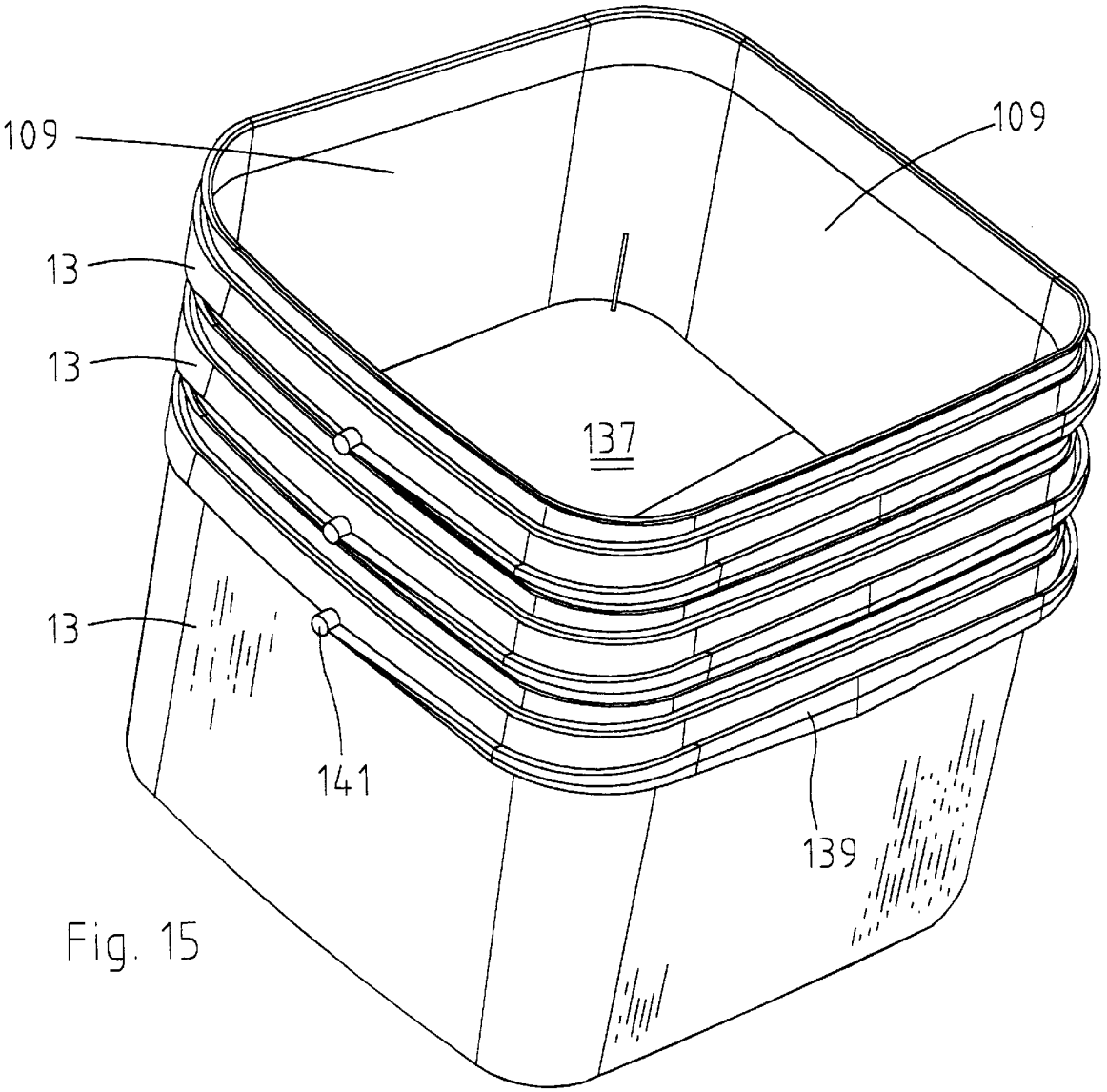
FIG. 15 is an illustrative view of three empty containers of this invention nested within each other.

A strut 47, preferably hinged at 49 along one edge to lid 1, is shown in FIG. 5 pivotable about said hinge from a first storage position, shown in dotted outline in FIG. 15, in a concave or depressed area 51, formed in lid surface 1, pivotally upward to a second position, shown by an arrow in FIG. 2, into contact at its opposite strut edge 53 with planar first surface 29, to support textured second surface 31 at angle "$\alpha$" in the second configuration. As shown in FIG. 2, strut 47 is preferably in the form of a bifid having two pairs of spaced-apart tabs 55 that engage like-spaced detents 59 in planar first surface 29. In depressed area 51, tabs 55 engage another set of detents 61, shown in dotted outline in FIG. 5 and formed in lid 1, in a slightly interference fit to hold strut 47 in storage in depressed area 51. Hinge 49 is preferably a "living" hinge the construction of which is already known in the prior art. Other than strut 47 and pivotal connection 41, cover 21 is solely supported by lid 1.

As shown in FIG. 3, a second opening 63 is formed in lid 1, and covered with a cap 65 through which to add tint or other paint ingredients or to dip a brush, etc. A small relief area 67 is formed in depressed area 51, for insertion of a person's finger tip or the tip of a screw driver to pry or pivot strut 47 from its storage position in depressed area 51.

Figure 19:
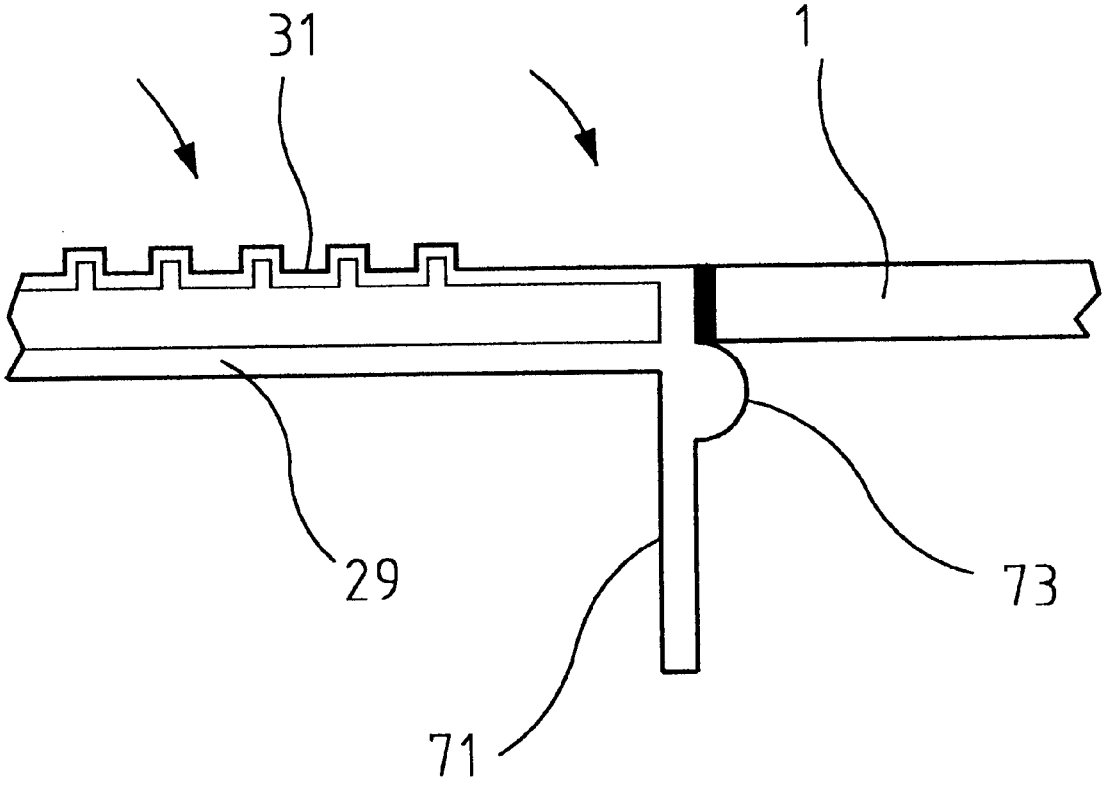

As shown in FIGS. 1–4, an upstanding short wall 71 is formed about textured second surface 31 and arranged to be positioned adjacent first opening peripheral boundary 17 when cover 21 is closed over first opening 15. Wall 71 acts as a confining means about textured second surface 31 to prevent paint from paint roller 19 from exuding or splashing outward and off second surface 31 in an unwanted direction when cover 21 is in its second configuration. As shown in FIG. 19, wall 71 is made slightly larger in size than first opening 15 so that when cover 21 is lowered into contact with first opening boundary 17, a slight interference fit occurs therebetween to form a seal against unexpected opening of cover 21 and spilling of paint from container 13. In addition, a small protuberance 73 is molded on the exterior of wall 71, slightly below the upper end thereof, so that, as cover 21 is closed over first opening 15, protuberance 73 passes from above to below first opening boundary 17 and becomes located thereunder to form an additional bar to unexpected opening of cover 21 and spilling of paint from container 13, such as when container 13 is tipped over.

Figure 6:
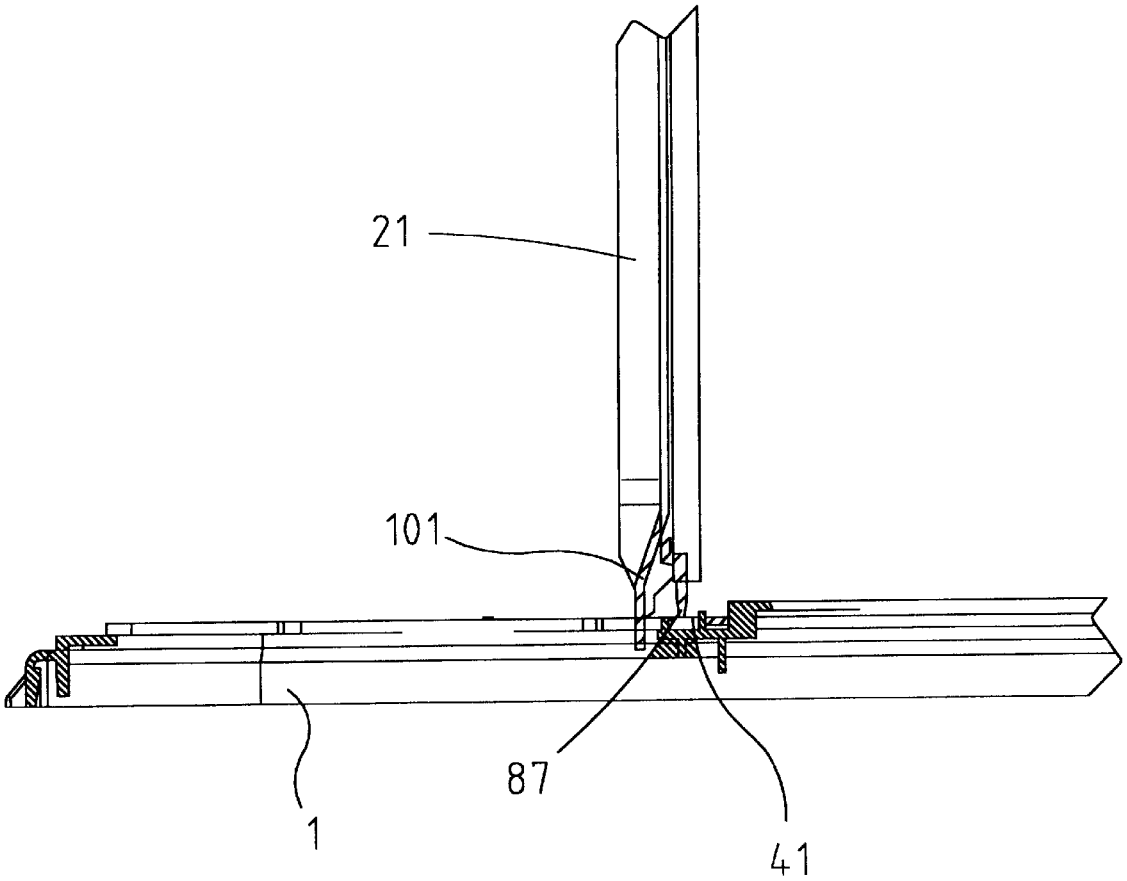
FIG. 6 is a side view of the lid with the cover arranged vertically upright just after the cover is attached to the lid.
Figure 7:
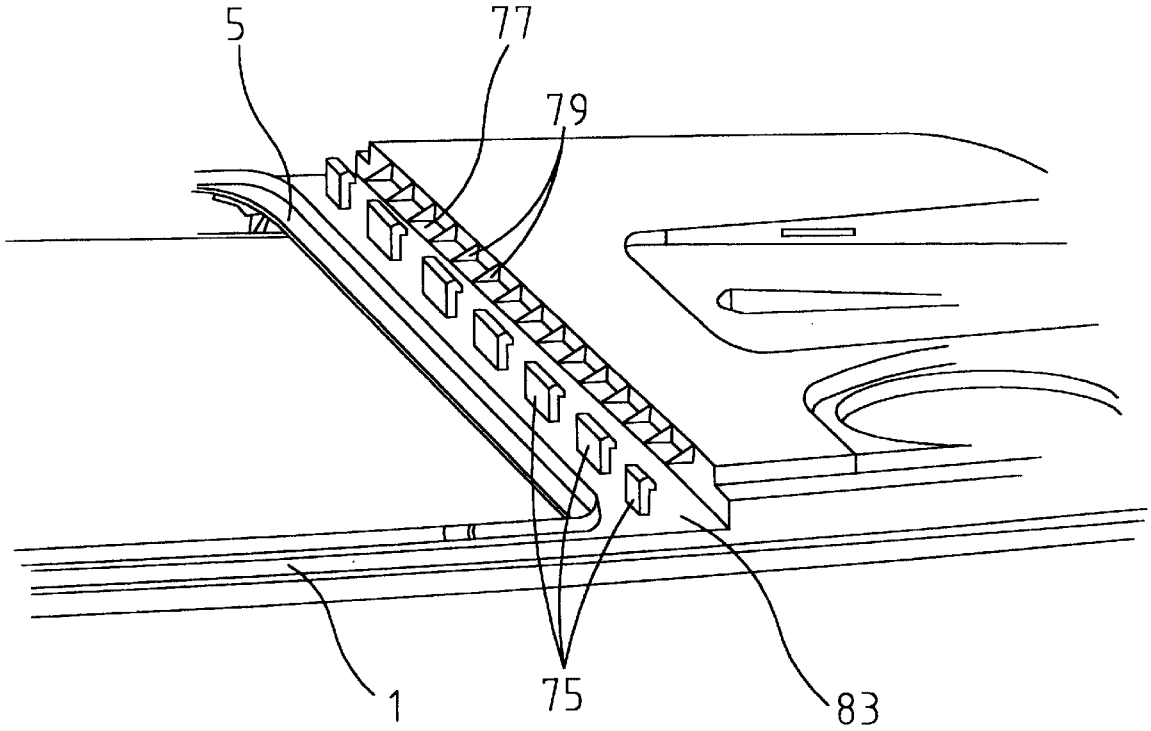
FIG. 7 is an isometric view of the lid with the cover removed and showing the preferred embodiment of the juncture between the cover and the lid.
Figure 8:
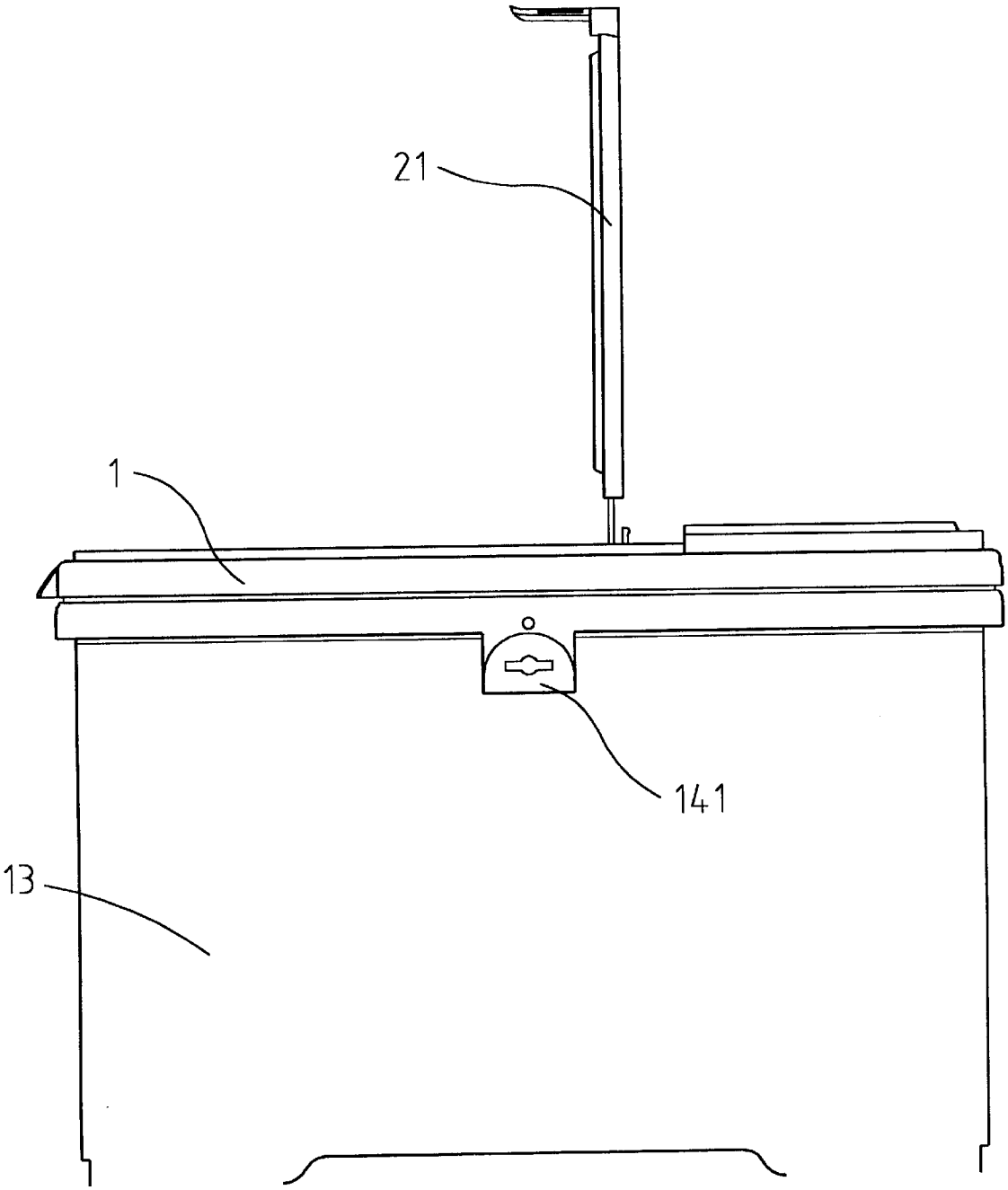
FIG. 8 is a side view of the lid with the cover arranged vertically upright after the lid is joined to a paint container.
Figure 9:
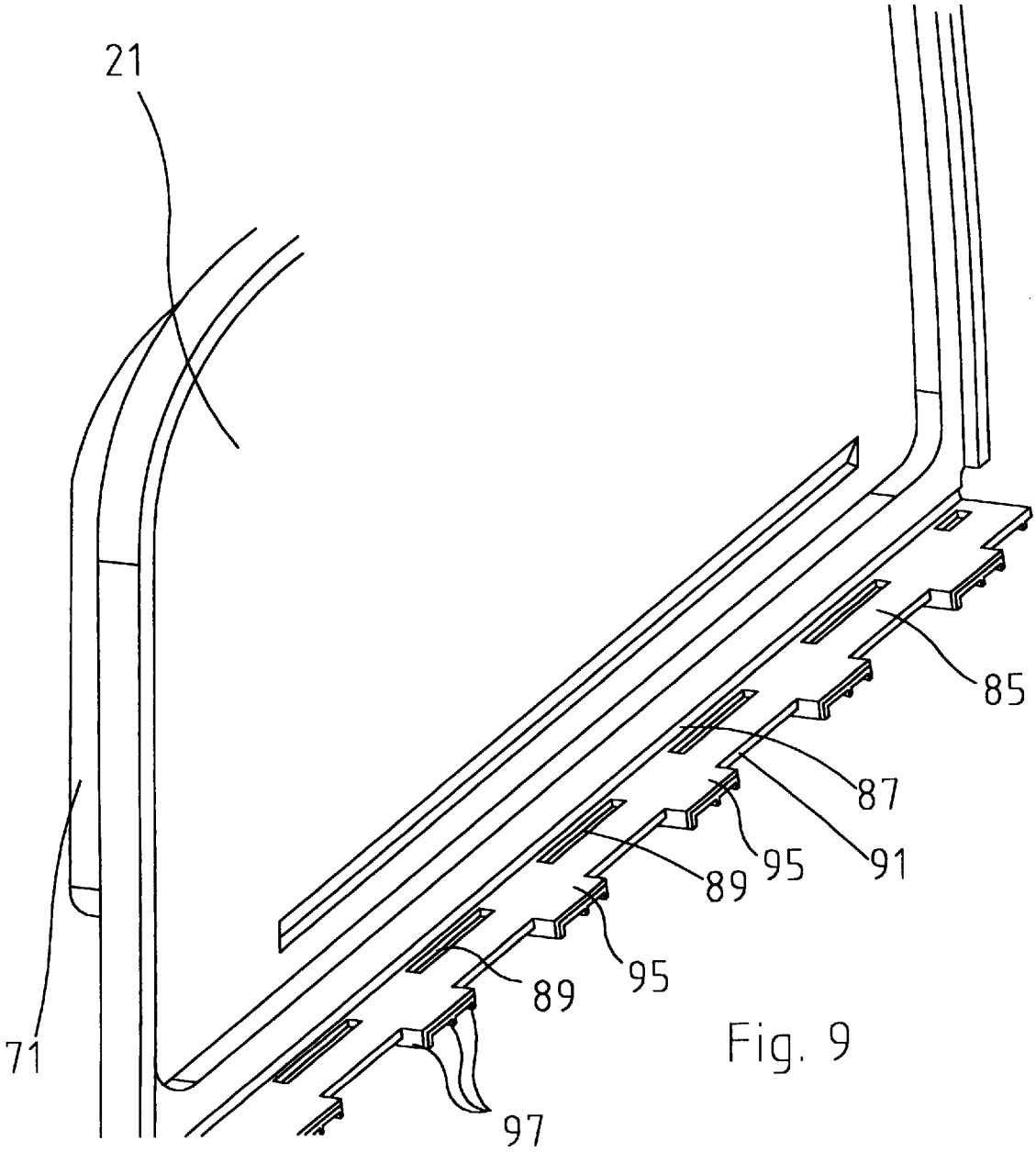
FIG. 9 is an isometric view of the end of the cover that is joined to the lid showing the preferred joint elements.
Figure 10:
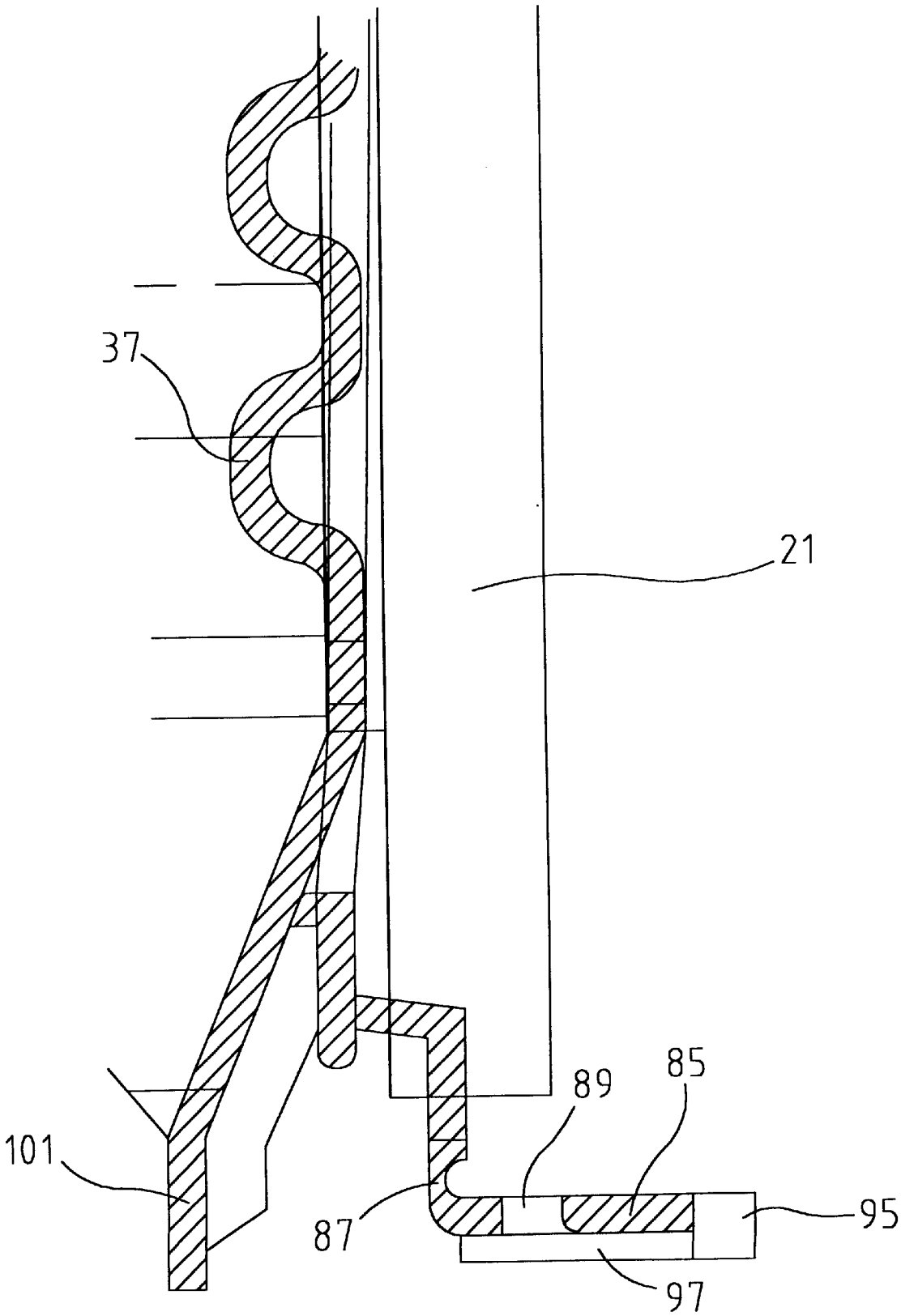
FIG. 10 is a sectional side view of the end of the cover shown in FIG. 9 showing a close-up arrangement of the preferred joint elements.
Figure 11:
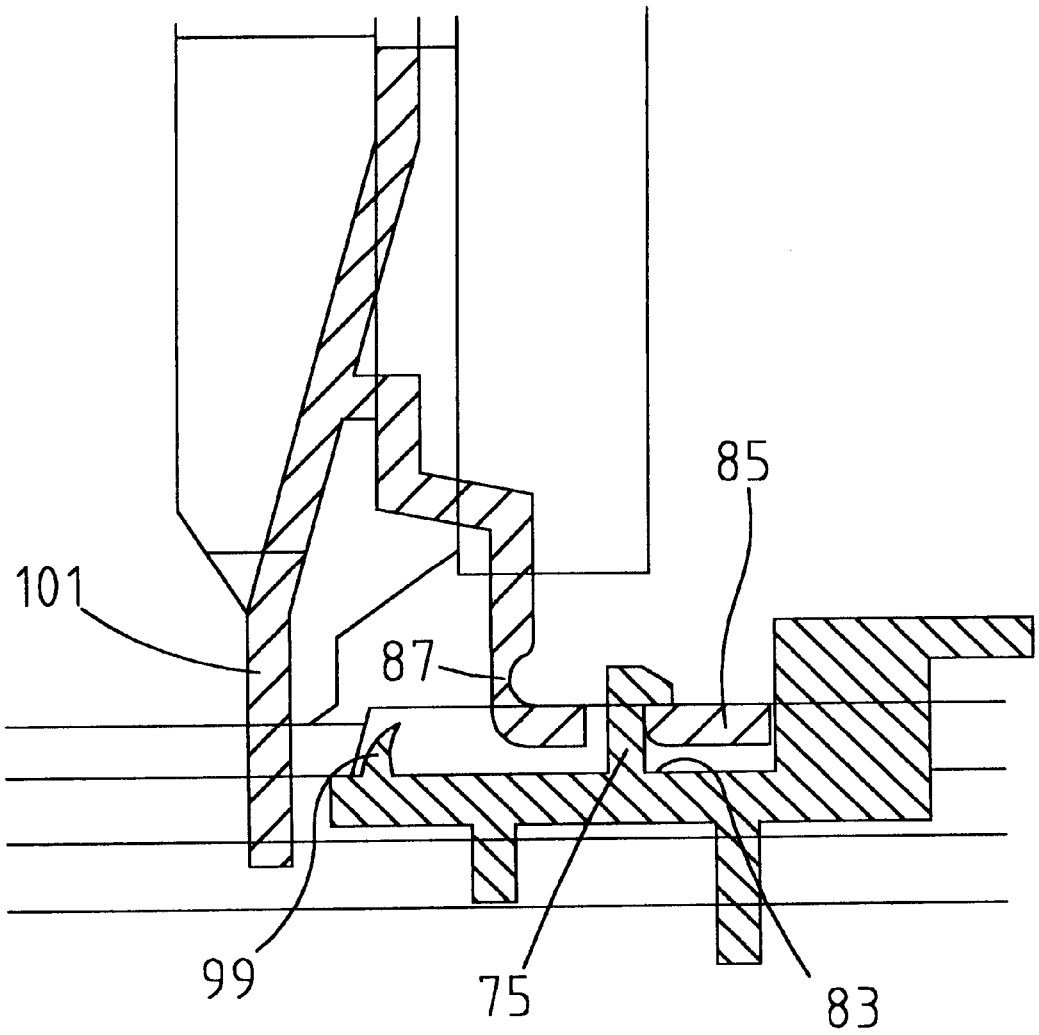
FIG. 11 is another sectional side view of the end of the cover shown in FIG. 9 showing the arrangement of other elements around the joint between the cover and the lid.

As shown in FIGS. 6 through 11, in the preferred embodiment of the joinder of cover 21 to lid 1, pivotal connection 41 is achieved by a forming a plurality of spaced-apart upstanding hooks 75. A ledge 77 is shown in FIG. 7, spaced-apart from hooks 75, is supported by a plurality of overhead supports 79 anchored to lid 1. Ledge 77 is spaced above a surface 83 formed on lid 1, slightly below planar surface 3. As shown in FIG. 9, a thin strip 85 is formed along cover edge 39 and pivotally attached to edge 39 by a hinge 87, such as a living hinge, of the type already known in the prior art. Strip 85 has a plurality of short, narrow slots 89 formed in spaced-apart arrangement therein in the same arrangement and spacing as hooks 75. Additionally, the edge 91 of strip 85, opposite hinge 87, has formed there along a plurality of tabs 95 supported on short, upstanding wall segments 97. As shown in FIGS. 6 through 10, to assemble cover 21 to lid 1, cover 21 is positioned over lid 1 in vertical arrangement, and strip 85 lowered down onto hooks 75 while tabs 95 are tabs 95 are passed between hooks 75 and under ledge 77. In final assembly, as shown in FIG. 11, strip 85 becomes planar with lid 1 and tabs 95 are locked under ledge 77 with hooks 75 preventing cover 21 from becoming loosened during manipulation of cover 21. As an added seal to the junction between cover 21 and lid 1, an upwardly-directed spur 99 is formed on surface 83 and arranged for contact by cover 21, during closure of cover 21 onto lid 1, where spur 99 is deformed against cover 21, and preferably deforms cover 21 slightly upward, to provide a still further seal against unwanted leakage of paint from container 13.

Also as shown in FIG. 6, an extension cuff 101 is formed along cover edge 39 and extends outward a short distance and over hinge 87, to direct paint, running down from roller 19 on angled textured second surface 31, back into container 13 and to prevent said paint from running down into hooks 89 and pivotal connection 41.

Figure 12:
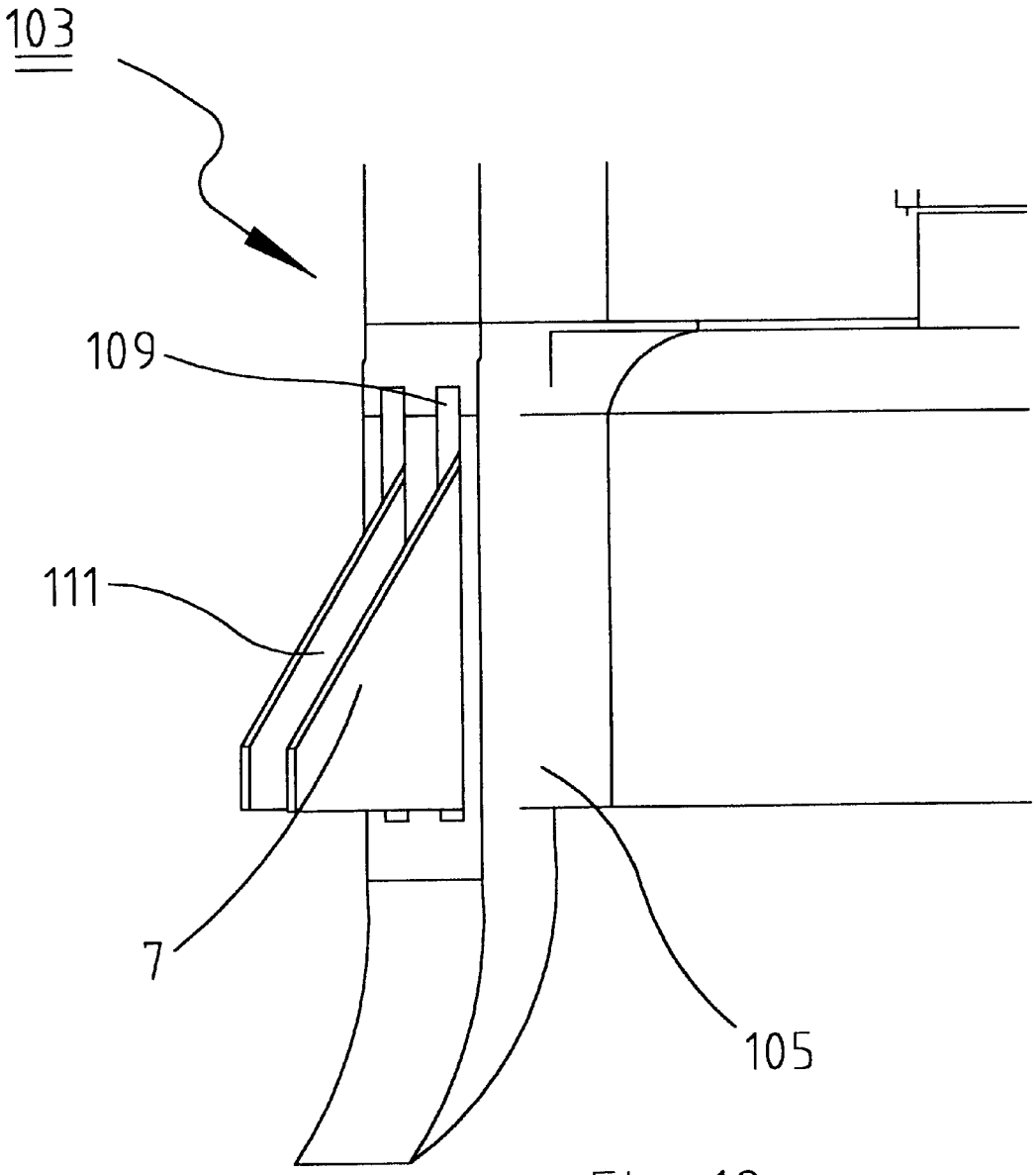
FIG. 12 is a close-up view of the latch used to hold the cover down tightly onto the lid.

As shown in FIGS. 1 and 12, at least one latch means 103 is formed on cover 21, preferably along peripheral edge 23 and opposite pivotal connection 41. Latch means 103 comprises a latch cover 105, pivotally attached to cover 21, and has formed therein an aperture 109 for receipt therethrough of one or more stubs 111, attached to cover peripheral edge 23. In the preferred embodiment of the invention, shown in FIG. 1, cover peripheral edge 23 extends forward so that latch means 103 may be made small enough not to interfere with stacking lids 1 or nesting of lid 1/paint container 13 combinations.

Figure 13A:
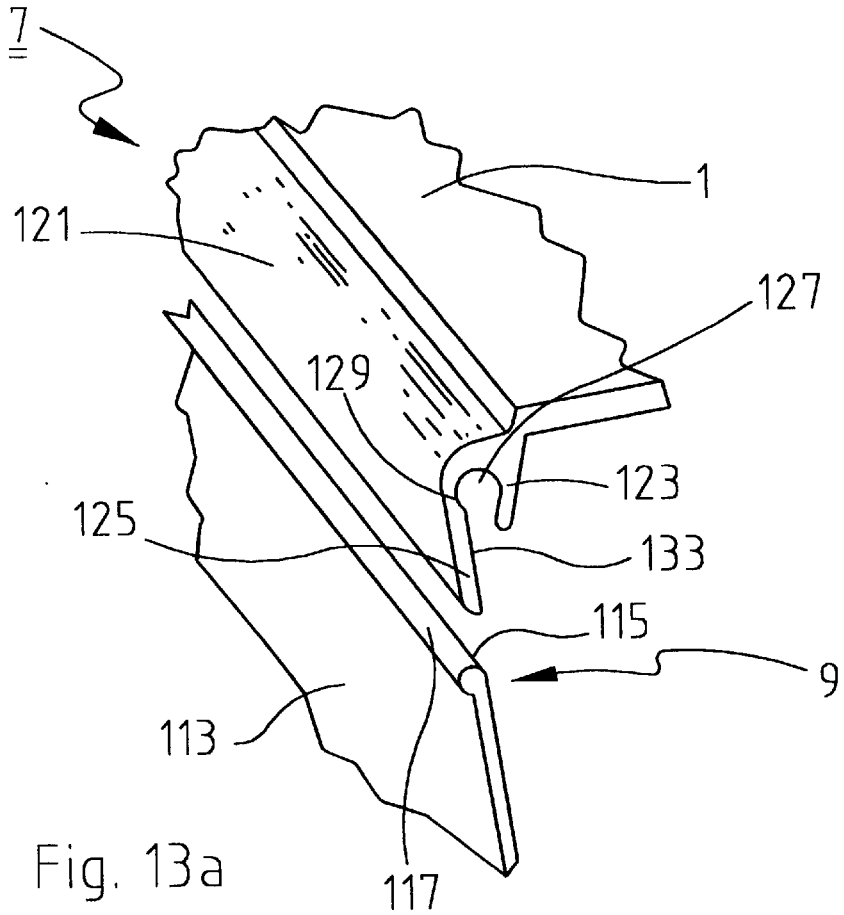
FIG. 13*a* is a sectional view of the sealing means, in an unsealed configuration, for sealing the border of the lid onto the upper boundary of the paint container.
Figure 13B:
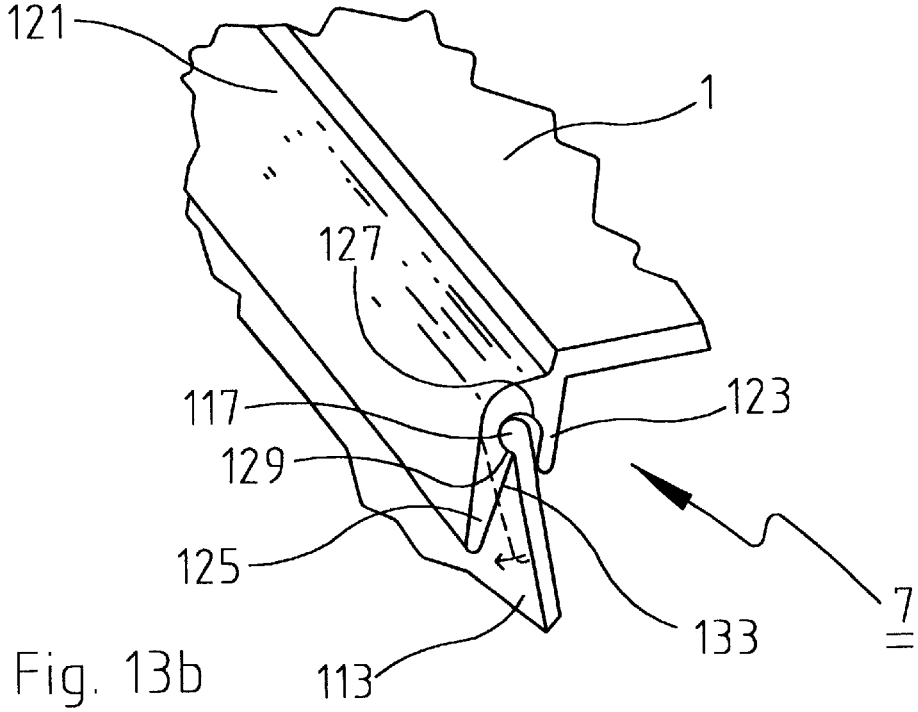
FIG. 13*b* is the same sectional view of the sealing means in FIG. 13*a* but in the sealed configuration.

As shown in FIGS. 13*a* and 13*b,* the preferred embodiment of first means 7, for attaching lid 1 about the boarder of a paint container, comprises having the side walls 113 of paint container 13 slant slightly outward from the base of the container so that a plurality of containers may be nested together when stored empty, as shown in FIG. 15. The upper peripheral edge 115 of container. boundary 9 terminates in a small, outwardly-facing bead 117. The peripheral edge 121 of lid 1 is preferably formed of a first, short, flexible, downwardly-directed short wall 123 and a second, longer, flexible, downwardly-directed wall 125, spaced-apart and outward from said first wall 123 and forming a space 127 therebetween. A notch 129, preferably having a radius the same as the radius of bead 117, is formed in the inner wall surface 133 of wall 117 for mating engagement with bead 117 when assembled therewith. Second, outer wall 125 is preferably made to slant inward toward the interior of lid 1 so that it must be flexed or biased outward, as shown by the arrow in FIG. 13*b,* before assembly. The pressure of bead 111 against notch 123 provides sealing engagement therebetween to seal lid 1 down on paint container 13.

While lid 1 is novel in itself, it may be combined with a paint container of rather specific dimensions to form a further novel lid/container combination. As shown in FIG. 14, lid 1 is made in a rectangular or square outline with rounded corners while container 13 is a deep, rectangular container with similar rounded corners. The sidewalls 109 of container 13 are slanted inward, preferably 1° to 5°, so that a plurality of empty containers 13, without lids, are nestable as shown in FIG. 10. Due to the planar nature of lid 1, when combined with container 13, as depicted in FIG. 14, when the lids of this invention ane attached to containers as shown, the lid-covered containers are stackable, one on top of the other, to save space in a store or at a work site. The same stackability is possible should the containers be cylindrical such as with a 5-gallon paint bucket.

Figure 16:
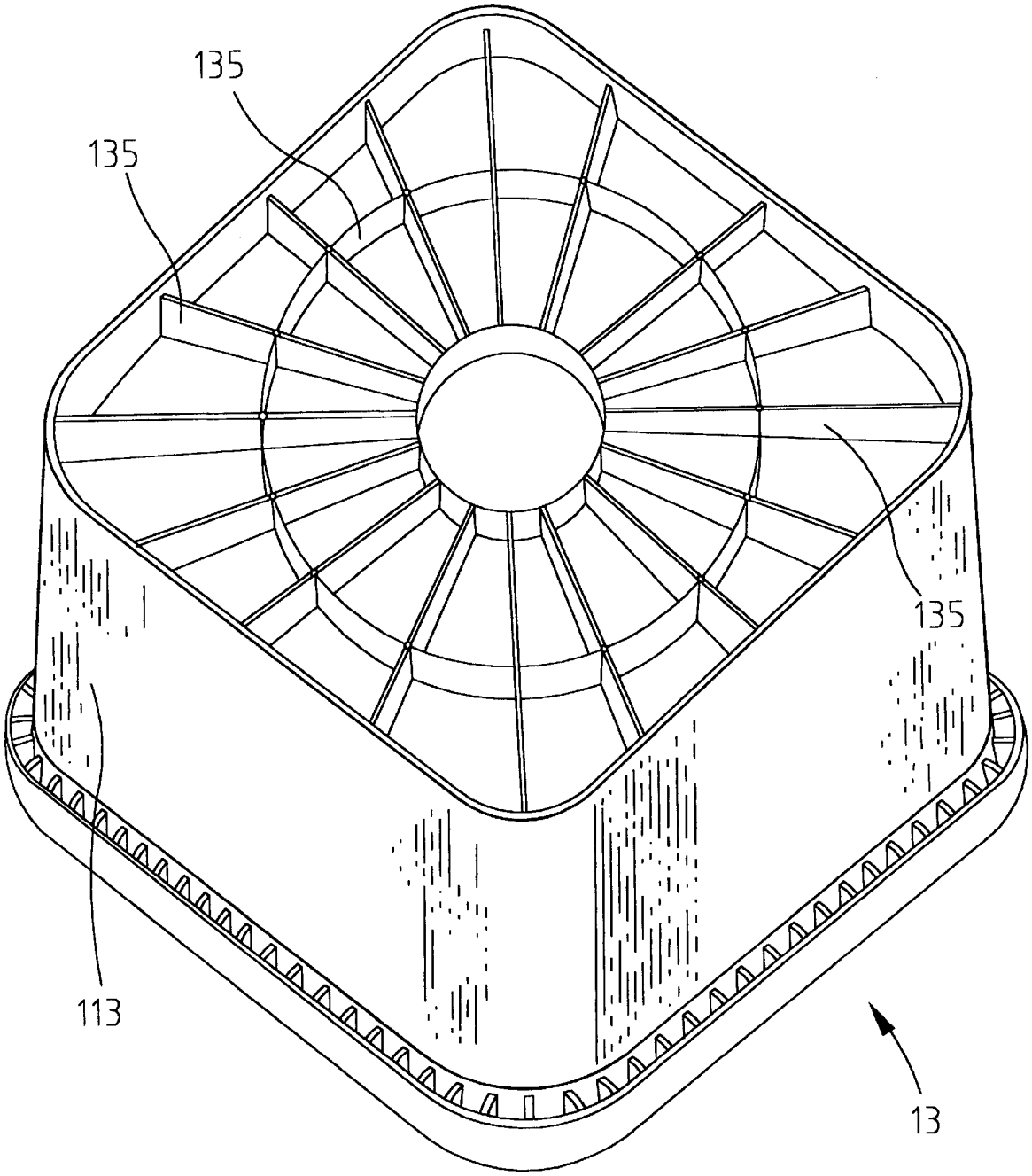
FIG. 16 is an isometric view of the bottom of a typical container of this invention showing the support ribs and the skirt surrounding the periphery thereof.

As shown in FIG. 16, the underside of container 13 preferably has a plurality of spaced-apart ribs 135 formed thereon extending downward below container floor 137 between said container side walls 113. Ribs 135 act to provide exterior support to container floor 137 and allow the entire container to be made of a lighter and thinner plastic than would be possible without them. As shown in FIG. 15, a handle 139 is provided to container 13, for the purpose of lifting it. Handle 139 is preferably attached to container 13 near upper boundary 9, at attachment points 141.

Figure 17:
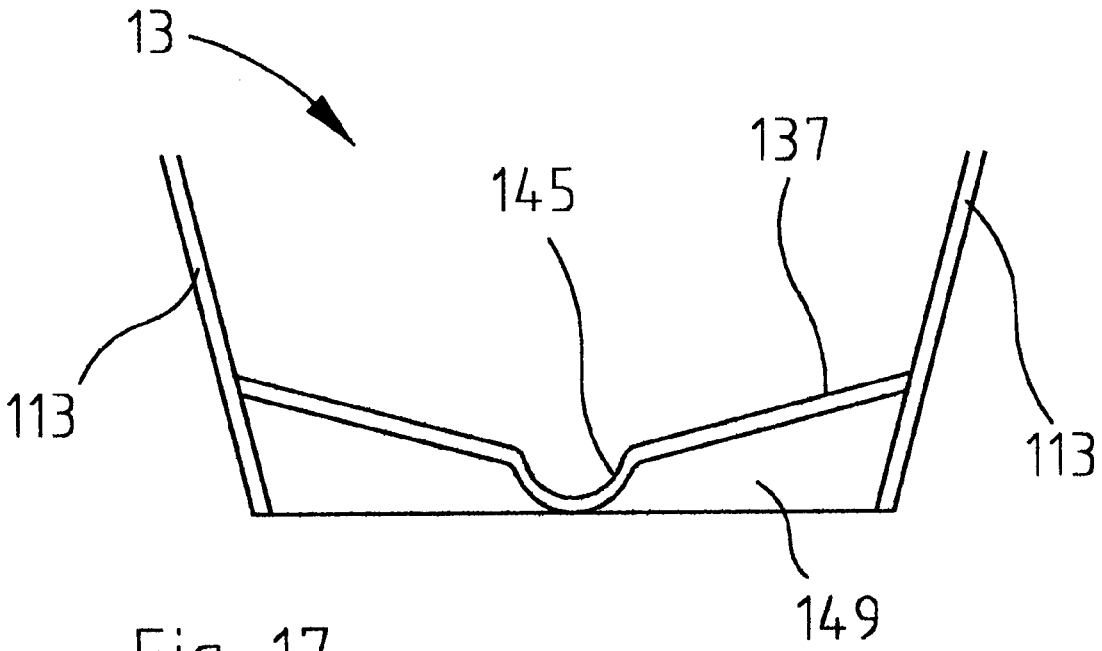
FIG. 17 is a side sectional view taken through a typical container used in this invention showing one embodiment of the floor structure of this invention as well as the ladder attachment of the invention.

Another novel embodiment of this invention is shown in FIGS. 12, 13 and 14 where side walls 109 are slanted slightly outward from the bottom of container 13 and, further, container floor 137 is slanted from one or both sides of container 13. As shown in FIG. 17, floor 123 is slanted from opposite side walls 113 of container 13 toward the middle thereof where a curved channel 145 is formed to receive the last remnants of paint left in container 13 to be efficiently picked up by paint roller 19.

Figure 18:
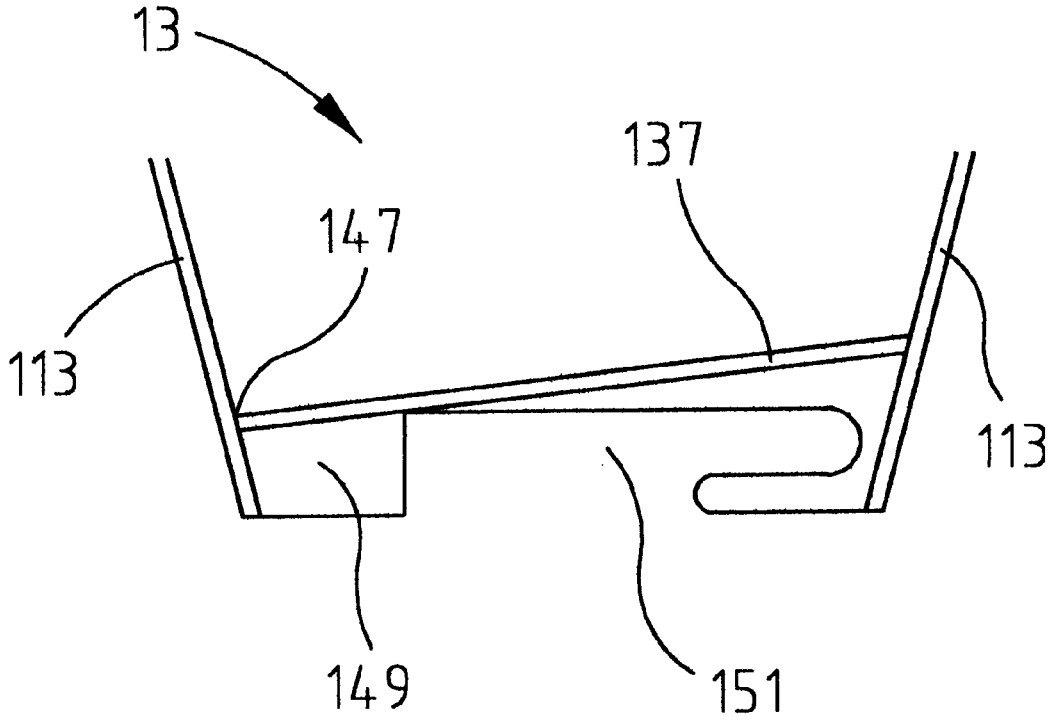
FIG. 18 is another side sectional view taken through a typical container used in this invention showing another embodiment of the floor structure of this invention; and, FIG. 19 is a close-up view of the junction between the cover and the lid about the periphery of the first opening.

In FIG. 18, container floor 137 is slanted from one side wall across the entire width of container 13 to the opposite side wall, forming an angular channel 147 against one side of container 13. This channel, as well as curved channel 145 allows the user of this novel lid to reach through first opening 15 with paint roller 19 and recover the last remnants of paint left in container 13.

As further shown in FIG. 18, container 13 is formed with support ribs 135, as previously described, and container side walls 113 are extended below said ribs to form a skirt 149. An elongated cut-out 151 is formed in skirt 149 on opposite sides of container 13. Cut-out 151 is formed of a dimension sized to accept therein the flat rung, flat step or top plate of a common step ladder (not shown) to hold container 13 thereon in somewhat of a cantilever fashion. While this may be imprudent with large-volume, heavy, paint containers, it should be suitable for shallower containers that hold less than 1 or 2 gallons of paint.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A paint container lid with integral, self-supporting paint roller tray comprising:

a) a planar lid surface defined by a peripheral border and including means for attaching said border in sealing relationship to an upper boundary of the side walls of a paint container;

b) a first opening formed in said lid surface defined by a peripheral boundary;

c) a cover for said first opening having a planar first surface and an opposite, textured second surface, said cover pivotally attached along a portion thereof to said lid and including means for attaching said cover over said first opening, said cover capable of first and second configurations with said lid;

d) in said first configuration, said planar first cover surface is arranged in co-planar relationship with said planar lid surface when said cover is placed flat over said opening and sealed thereto with said planar first cover surface facing upward;

e) in said second configuration, said textured, second cover surface is arranged facing upward at an acute angle with said lid, said cover slanting toward said first opening, to act as a paint roller tray; and, f) a support integral with said lid surface moveable from a first storage position to a second support position against said cover when said cover is in said second configuration.

2. The paint container lid with integral, self-supporting paint roller tray of claim 1 further including a second opening formed in said lid and coverable with a cap through which to add tint or other paint ingredients.

3. The paint container lid with integral, self-supporting paint roller tray of claim 1 wherein said textured second surface of said cover contains a plurality of protrusions.

4. The paint container lid with integral, self-supporting paint roller tray of claim 1 wherein said textured second surface of said cover contains a plurality of narrow, spaced-apart ribs.

5. The paint container lid with integral, self-supporting paint roller tray of claim 1 further including an extension cuff formed along said cover pivotal connection to said lid extending outward and over said pivotal connection between said cover and said lid to direct paint running down said textured second surface into said container.

6. The paint container lid with integral, self-supporting paint roller tray of claim 1 wherein said integral support is bifid.

7. The paint container lid with integral, self-supporting paint roller tray of claim 1 wherein said first opening is at least as wide as a paint roller assembly to allow the assembly to be passed, in level attitude, through said opening.

8. The paint container lid with integral, self-supporting paint roller tray of claim 1 further including an upstanding short wall formed about said textured second surface and arranged adjacent said first opening peripheral boundary when said cover is in said first configuration, to act as a confining means about said textured second surface to prevent paint from splashing outward and off said second surface in an unwanted direction when said cover is in said second configuration.

9. The paint container lid with integral, self-supporting paint roller tray of claim 8 wherein said short wall is dimensioned to form an interference fit with said boundary of said first opening to prevent spillage of paint from the container when the container is tipped over.

10. The paint container lid with integral, self-supporting paint roller tray of claim 8 wherein said short wall further has formed thereon a small protuberance, exterior of said wall and slightly below said textured second surface thereof, so that, as said cover is closed over said first opening, said protuberance passes from above to below said boundary of said first opening and becomes located thereunder to form a bar to unexpected opening of said cover and spilling of paint from said container, such as when said container is tipped over.

11. The paint container lid with integral, self-supporting paint roller tray of claim 1 wherein said means for attaching said cover over said first opening includes at least one latch formed on said cover.

12. The paint container lid with integral, self-supporting paint roller tray of claim 11 wherein said latch comprises a latch cover pivotally attached to said cover and having formed therein an aperture for receipt therethrough of a stub extending from said lid.

13. The paint container lid with integral, self-supporting paint roller tray of claim 12 wherein said latch lies along an edge of said cover opposite said pivotal connection.

14. The paint container lid with integral, self-supporting paint roller tray of claim 1 wherein said pivotal attachment of said cover along a portion thereof comprises:

a) a plurality of spaced-apart upstanding hooks formed on said lid surface slightly depressed from said first planar surface;

b) a ledge, spaced-apart from said hooks, supported by a plurality of overhead supports anchored to said lid, said ledge spaced-above said surface formed on said lid;

c) a thin strip is formed along said connecting edge of said cover and pivotally attached to said edge by a hinge, said strip having a plurality of short, narrow slots formed in spaced-apart arrangement therein in the same arrangement and spacing as said hooks; and, d) an edge formed on said strip, opposite said hinge, having formed there along a plurality of tabs supported on short, upstanding wall segments and arranged to fit between said hooks and under said ledge;

e) wherein, in the assembly of said cover to said lid, said cover is positioned over said lid in vertical arrangement, and said strip is lowered down onto said hooks while said tabs are passed between said hooks and under said ledge.

15. The paint container lid with integral, self-supporting paint roller tray of claim 14 wherein said hinge on said strip is a living hinge.

16. The paint container lid with integral, self-supporting paint roller tray of claim 14 further including an upwardly-directed spur formed on said lid surface and arranged for contact by said cover, during closure thereof onto said lid, where said spur is deformed against said cover and deforms said cover slightly upward, to provide a seal against unwanted leakage of paint from said container.

17. The paint container lid with integral, self-supporting paint roller tray of claim 1 wherein said support is hinged along one edge to said lid and is pivotable thereabout from said first storage position in a depressed area, formed in said lid surface, upward to said second support position, at an acute angle with said lid, in contact with said cover.

18. The paint container lid with integral, self-supporting paint roller tray of claim 17 further including a small relief area formed in said depressed area, spanning one edge of said support for insertion of a person's finger tip to pry said support from said storage position.

19. The paint container lid with integral, self-supporting paint roller tray of claim 17 further including a pair of detents formed in said depressed area to contact said support in a slight interference fit to hold said support in storage position therein.

20. The paint container lid with integral, self-supporting paint roller tray of claim 17 wherein said support contacts said cover through a detent formed in said first cover surface to support said second textured surface at said acute angle in said second configuration of said cover.

21. The paint container lid with integral, self-supporting paint roller tray of claim 20 wherein said acute angle is 30°.

22. In combination, a paint container and paint container lid with integral, self-supporting paint roller tray comprising:

a) a paint container having a floor and enclosed side walls terminated by an upper open boundary;

b) a planar lid surface defined by a peripheral border and including means for attaching said border in sealing relationship to the periphery of said upper boundary of said paint container;

c) a first opening formed in said lid surface defined by a peripheral boundary;

d) a cover for said first opening having a planar first surface and an opposite, textured second surface, said cover pivotally attached along a portion thereof to said lid and including means for attaching said cover over said first opening, said cover capable of first and second configurations with said lid;

e) in said first configuration, said planar first cover surface is arranged in co-planar relationship with said planar lid surface when said cover is placed flat over said opening and sealed thereto with said planar first cover surface facing upward;

f) in said second configuration, said textured, second cover surface is arranged facing upward at an acute angle with said lid, said cover slanting toward said first opening, to act as a paint roller tray; and, g) a support integral with said lid surface moveable from a first storage position, to a second support position against said cover when said cover is in said second configuration.

23. The combination paint container and paint container lid with integral, self-supporting paint roller tray of claim 22 wherein said means for attaching said border to said container comprise:

a) a small, outwardly-facing bead formed on said upper boundary of said paint container; and, b) an outer, flexible border wall extending downwardly from said peripheral border having a notch formed therein for passing over said bead and locking thereagainst to hold said lid in tight, sealing attachment to said container.

24. The combination paint container and paint container lid with integral, self-supporting paint roller tray of claim 22 wherein said means for attaching said border to said container comprise:

a) a small, outwardly-facing bead formed on said upper boundary of said paint container;

b) a first, short, flexible, downwardly-directed wall and a second, longer, flexible, downwardly-directed wall spaced-apart and outward from said first wall formed on said border, said first and second walls forming a space therebetween bounded by inner and outer wall surfaces; and, c) a notch, having a radius the same as said radius of said bead, formed in said inner wall surface of said second wall, adapted for mating engagement with said bead when assembled therewith; wherein, d) said second wall is arranged to slant slightly inward toward the interior of said lid so that it must be flexed outward before assembly with said container side walls, so that the bias pressure of said second wall and notch against said container bead provides sealing engagement therebetween.

25. The combination of a paint container and paint container lid of claim 22 wherein said side walls of said container are slanted to allow a plurality of empty containers to be stored in nested configuration.

26. The combination of a paint container and paint container lid of claim 22 further including at least one rib formed underneath said floor of said container to provide stiffening support for said floor to hold the contents of said container.

27. The combination of a paint container and paint container lid of claim 22 wherein said floor of said container is slanted from one said side wall to the opposite said side wall to concentrate a small volume of paint in a single location for efficient pickup by a paint roller.

28. The combination of a paint container and paint container lid of claim 22 wherein said container side walls extend below said floor to form a skirt about the floor of said container and further including an elongated cut-out formed in said skirt, on opposite sides of said container, each said cut-out of a dimension sized to accept therein the flat rung, flat step, or top plate of a common step ladder to hold container thereon in slightly cantilever fashion.

29. The combination of a paint container and paint container lid of claim 22 wherein said floor of said container is slanted from opposite side walls of said container to the center of said container to concentrate the paint in a single location for efficient pickup by a paint roller.

30. The combination of a paint container and paint container lid of claim 29 wherein a curved channel is formed at said center of said floor of said container to concentrate the paint in a single location for efficient pickup by a paint roller.

* * * * *